US007294799B2

(12) United States Patent
Meyer et al.

(10) Patent No.: US 7,294,799 B2
(45) Date of Patent: Nov. 13, 2007

(54) SMOOTH KEYBOARD WITH LOW KEY HEIGHT

(75) Inventors: Steven H. Meyer, Austin, TX (US); Joel A. East, Austin, TX (US); Kenneth A. Fuselier, Austin, TX (US)

(73) Assignee: iKey, Ltd., Austin, TX (US)

( * ) Notice: Subject to any disclaimer, the term of this patent is extended or adjusted under 35 U.S.C. 154(b) by 0 days.

(21) Appl. No.: 11/249,961

(22) Filed: Oct. 13, 2005

(65) Prior Publication Data

US 2007/0084704 A1 Apr. 19, 2007

(51) Int. Cl.
*H01H 13/70* (2006.01)

(52) U.S. Cl. ..... 200/302.1

(58) Field of Classification Search ..... 200/5 A, 200/511, 512, 517, 341, 302.1, 302.2; 341/22, 341/34; 345/168, 169; 361/680; 400/472
See application file for complete search history.

(56) References Cited

U.S. PATENT DOCUMENTS

| | | | | |
|---|---|---|---|---|
| 4,074,088 | A | 2/1978 | Keough et al. | |
| 4,314,117 | A | 2/1982 | Ditzig | |
| 4,472,610 | A | 9/1984 | Fuller et al. | |
| D276,230 | S | 11/1984 | Akiyama | |
| 4,563,550 | A * | 1/1986 | Bertina | 200/5 A |
| 4,701,747 | A | 10/1987 | Isherwood et al. | |
| 4,703,160 | A * | 10/1987 | Narishima et al. | 235/1 D |
| 4,772,769 | A | 9/1988 | Shumate | |
| 5,021,638 | A | 6/1991 | Nopper et al. | |
| 5,096,317 | A | 3/1992 | Phillippe | |
| 5,138,119 | A | 8/1992 | Demeo | |
| D357,911 | S | 5/1995 | Grant et al. | |
| 5,457,480 | A * | 10/1995 | White | 345/163 |
| 5,510,782 | A | 4/1996 | Norris et al. | |
| 5,521,342 | A * | 5/1996 | Bartley et al. | 200/5 A |
| 5,642,805 | A | 7/1997 | Tefft | |
| 5,699,083 | A | 12/1997 | Lo | |
| 5,717,565 | A | 2/1998 | Raasch | |
| 5,743,381 | A | 4/1998 | Patak et al. | |
| 5,777,281 | A | 7/1998 | Riddiford | |
| 5,847,336 | A | 12/1998 | Thornton | |
| 5,903,548 | A | 5/1999 | Delamater | |
| 5,917,437 | A | 6/1999 | Ojala et al. | |
| 5,923,522 | A * | 7/1999 | Sajna | 361/288 |
| 6,057,517 | A | 5/2000 | Meyer | |

(Continued)

OTHER PUBLICATIONS

"iKey Industrial Peripherals Catalog"; iKey; 2004; pp. 1-24.

(Continued)

*Primary Examiner*—Michael A. Friedhofer

(57) ABSTRACT

A smooth keyboard with low-key height for association with a keyboard control circuit includes a top enclosure having a generally impenetrable surface, the surface comprising a plurality of keys and a seal edge. A pliable webbing surrounded the keys such that there are no gaps between the keys or between the keys and the top enclosure, the pliable webbing creating a generally impenetrable seal between the keys and between the keys and the top enclosure, the seal edge having a rib. A bottom enclosure formed as a single unit that forms a generally impenetrable surface having a seal edge, the seal edge having a trough, the trough for receiving the rib to form a generally impenetrable seal surrounding the keyboard control circuit.

26 Claims, 11 Drawing Sheets

U.S. PATENT DOCUMENTS 6,215,420 B1 * 4/2001 Harrison et al. ..... 341/22
6,219,038 B1 * 4/2001 Cho ..... 345/173
D441,361 S 5/2001 Sanders
6,323,842 B1 11/2001 Krukovsky
D455,428 S 4/2002 Andres et al.
6,424,522 B1 7/2002 Lin et al.
D462,682 S 9/2002 Andres et al.
6,469,693 B1 10/2002 Chiang et al.
6,563,435 B1 5/2003 Platz
6,573,463 B2 * 6/2003 Ono ..... 200/5 A
6,610,944 B2 8/2003 Lee et al.
6,633,986 B1 10/2003 Sellers
D481,735 S 11/2003 Marucci et al.
6,657,616 B2 12/2003 Sims
D485,271 S 1/2004 Kamegi
6,690,359 B1 2/2004 Felton
6,705,787 B2 3/2004 Jeffries et al.
D492,308 S 6/2004 Ozolins et al.
D492,309 S 6/2004 Buhler
6,765,158 B1 * 7/2004 Morrison et al. ..... 200/5 R
6,798,396 B2 9/2004 Gemunder et al.
6,803,865 B2 10/2004 DeLuga
D500,318 S 12/2004 Buhler
6,871,978 B2 3/2005 Chan et al.
6,896,948 B1 5/2005 Griswold
6,921,054 B2 7/2005 Doan
6,922,186 B2 7/2005 Whitcomb
6,935,894 B2 * 8/2005 Fung ..... 439/606
D516,070 S 2/2006 Ozolins et al.
7,006,075 B1 2/2006 Olson
7,030,330 B2 4/2006 Suda
D522,513 S 6/2006 Lo
7,087,850 B1 8/2006 Murzanski
2003/0223797 A1 12/2003 Uke
2004/0095329 A1 5/2004 Sexton

OTHER PUBLICATIONS

"iKey Industrial Peripherals Catalog"; iKey; 2004; pp. 25-48.

* cited by examiner 104
62

100

61
111
112
124
105
106
113
Esc
Fn
Shift
Ctrl
Alt
Apps Lock
Enter
Backspace
Delete
Insert
Home
End
Page Up
Page Up
Num Lock
Scroll Lock
Pause
Print Sc Sys Rq Pill Detail All Keys

SIDE VIEW KEYS A,C,D,E,& J

I CLEAR LETTERING FOR SCROLL AND NUM LOCK KEYS

DETAIL A- WRAP AROUND DETAIL

DETAIL B- WRAP AROUND DETAIL

DETAIL C- WRAP AROUND DETAIL

SMOOTH KEYBOARD WITH LOW KEY HEIGHT

FIELD OF THE INVENTION

This invention pertains generally to computer systems and, more particularly, to a smooth keyboard with pliable webbing that allows very low key height, which is used to control a computer system.

BACKGROUND OF THE INVENTION

A computer system includes many components, such as the central processing unit (or processor); temporary memory for storing program instructions (like random access memory, or RAM); a permanent storage device (such as a hard disk); and a variety of user interface devices, such as a video display, a keyboard, and a pointing device.

The keyboard may come in a variety of physical embodiments. The most familiar is a plastic enclosure made of two halves that are fixed together with at least one cutout in the top half for a keypad. The standard keyboard has an alphanumeric keypad with a number keypad to the right. The keypads have keys that correspond to pressure sensitive switches. The pressure sensitive switches are mounted on a printed circuit board (PCB) underneath the keypads and within the enclosure. The PCB also has a keyboard control circuit that, when a key is pressed, determines which key was pressed and transmits an electrical signal to the computer system. The computer system then decodes the electrical signal and performs some defined action such as printing a character on the video display or executing a defined command. Other embodiments of a keyboard include different alphanumeric keypad layouts, reduced size keypads and keyboards, metal enclosures, cutouts for each individual key, integration of a pointing device, etc.

Because of the general acceptance and use of computers for countless operations, they appear in use for an increasing number of different work and entertainment environments. This includes harsh environments that may include dampness, wetness, damaging gases, heavy particulate matter, dangerous contaminants, or medical hazards. Within these environments, such user keyboards may be or become inoperative because of the environmental constituents entering their mechanical, electrical, and electronic portions or become unsafe because of contaminants collecting on their surface or within their many gaps and crevices.

In the past, computers and peripherals have been restricted to use in carefully controlled environments. As discussed, conventional computer terminal keyboards have a housing with many discrete, closely-spaced alpha-numeric keys protruding upward through openings in the top of the keyboard. In many environments, spills and dirt can easily enter the keyboard and soon disable it. Keyboards are known with internally sealed electronics to provide protection against liquid spills, but debris can still enter spaces within the keys and foul their operation.

Today, some computer keyboards and peripherals are designed to operate in environments replete with a broad array of contaminants that would make use of less well-designed keyboards or peripherals either highly impractical or wholly impossible. For example, certain keyboards exist that are designed for the specific needs of healthcare environments and infection control. Such keyboards are seemingly ideally suited for use in operating rooms, patient rooms, with medical carts or retractable workstations because these keyboards provide a reliable waterproof keyboard that can be wiped down using hospital disinfecting sprays or germicidal wipes. However, even these specialty keyboards still have unnecessary edges, gaps, crevices, textures, and seams that provide places for contaminants to accumulate and make sanitizing difficult or impossible.

The "feet" of current keyboards including specialty keyboards are a good example. When the user wants the keyboard to lay flat against the table, the feet reside in recesses in the base of the keyboard. When the user wants the keyboard to be raised up off the table, the feet generally pivot out from the bottom enclosure. Both the recess and the feet themselves supply places for contaminants to collect and are difficult to clean because of their many nooks and crannies. Another example is the texturing on many keyboard surfaces. The texturing provides thousands of small crevices for contaminants to build up and makes sanitizing significantly more difficult.

In addition, the key's themselves have inherent sanitization problems. Because the keys are the most prominent and used component of the keyboard, they are more prone to contact with contaminants. The key's cube shape also unnecessarily increases the number of surfaces to be cleaned. These additional surfaces increase the probability that each key will not be properly sanitized and unnecessarily increase the complexity of, and time necessary to, properly sanitize the keyboard.

While computer device designers have attempted to produce a rugged keyboard for harsh environments that is easy to sanitize, none has yet overcome the problems of providing a waterproof sealed keyboard with minimal seams, crevices, and gaps to lower the accumulation of contaminants and make sanitization simpler and more effective.

Accordingly, there is a need for a rugged sealed keyboard with a low-key height and smooth surface with minimal seams, crevices, and gaps to lower the accumulation of contaminants and make sanitization simpler and more effective.

BRIEF SUMMARY OF THE INVENTION

In one aspect of the present invention, a keyboard has a top enclosure with a generally impenetrable smooth surface and seal edge. The surface has several keys and each may have at least one pill corresponding to the location of a pressure sensitive switch. Surrounding and connecting each key to the enclosure is a pliable webbing that provides a generally impenetrable seal and provides tactile resistance to key actuation. The pliable webbing also lowers both the key height and the key travel. The surface may have formed thereon a pointer region that corresponds to a directionally sensitive device and may also have at least one "mouse" button corresponding to a pressure sensitive switch.

In another aspect of the present invention, beneath the top enclosure is a printed circuit board (PCB) with a keyboard control circuit. The keyboard control circuit includes several pressure sensitive switches corresponding to the keys. When a key is pressed, the pill is compacted and closes a circuit such that a signal flows to the keyboard control circuit which determines which key was pressed. The PCB may also contain a mouse control circuit that includes at least one directionally sensitive device corresponding to the pointer region and circuitry to determine which direction the directionally sensitive device was pressed or moved. The mouse control circuit may also contain at least one mouse button and circuitry to determine when the mouse button is pressed.

Beneath the PCB is a bottom enclosure with a generally impenetrable smooth surface and seal edge. The bottom enclosure attaches to the top enclosure to form a generally impenetrable seal surrounding the PCB and components from the environment. The surface may have formed thereon at least one foot. The foot is a convexity protruding out of the bottom enclosure intended to raise the keyboard off an associated table. The foot is designed to be smooth and have minimal crevices. In addition, there may be at least one cable hole in the rear of the bottom enclosure for a cable to connect the keyboard to an associated computer system. The cable passes through the cable hole and is secured by a cable strain relief. The cable strain relief forms a generally impenetrable seal and is designed to be smooth and have minimal crevices.

In yet another aspect of the present embodiment, the entire enclosure, cable strain relief, cable, and keys have round edges and are smooth, lacking any texture. The pill and pliable webbing arrangement lowers the key height and key travel. Lowering the key height and key travel both lowers the prominence of the key and decreases the time and complexity to properly sanitize the keyboard.

The present invention, therefore, provides a rugged keyboard for use with a computer system in a waterproof and sealed structure that is chemical resistant. Moreover, the present invention has a smooth enclosure with minimal seams, crevices, and gaps. In addition, the present invention has pliable webbing between and connecting each key to the enclosure. This pliable webbing lowers the key height and provides a smoother keypad surface with fewer seams, crevices, and gaps. The rugged keyboard of the present embodiment may be washed down with water or sterilized with disinfectant without damage and provides an attractive device for use with a computer in harsh industrial environments, manufacturing applications, laboratory situations, food service, and hospital and health care institutions.

These and other aspects of the disclosed subject matter, as well as additional novel features, will be apparent from the description provided herein. The intent of this summary is not to be a comprehensive description of the claimed subject matter, but rather to provide a short overview of some of the subject matter's functionality. Other systems, methods, features and advantages here provided will become apparent to one with skill in the art upon examination of the following FIGUREs and detailed description. It is intended that all such additional systems, methods, features and advantages that are included within this description, be within the scope of the accompanying claims.

BRIEF DESCRIPTIONS OF THE DRAWINGS

The novel features believed characteristic of the invention are set forth in the claims. The invention itself, however, as well as a preferred mode of use, further objectives, and advantages thereof, will best be understood by reference to the following detailed description of an illustrative embodiment when read in conjunction with the accompanying drawings, wherein:

Figure 10:
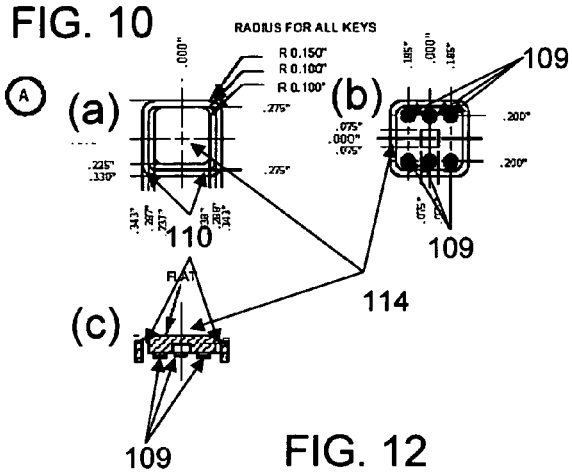
Figure 11:
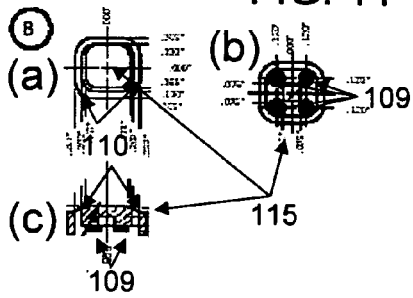
Figure 12:
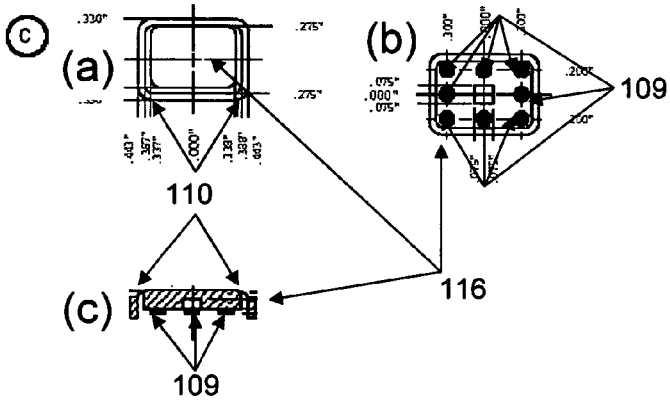
Figure 13:
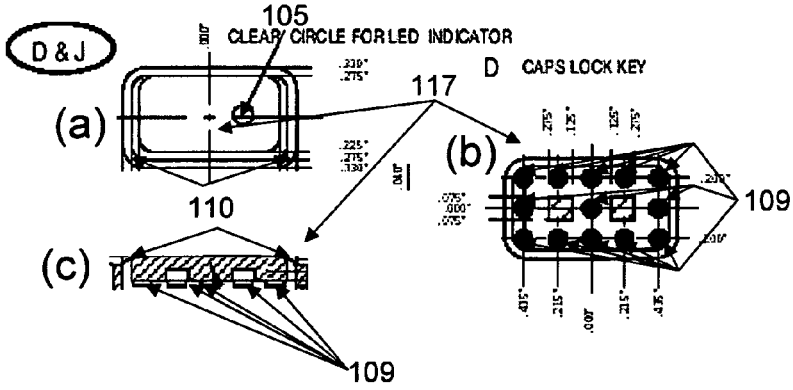
Figure 14:
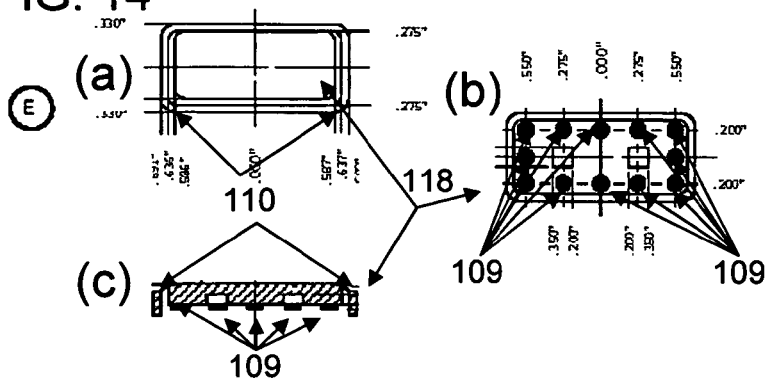
Figure 15:
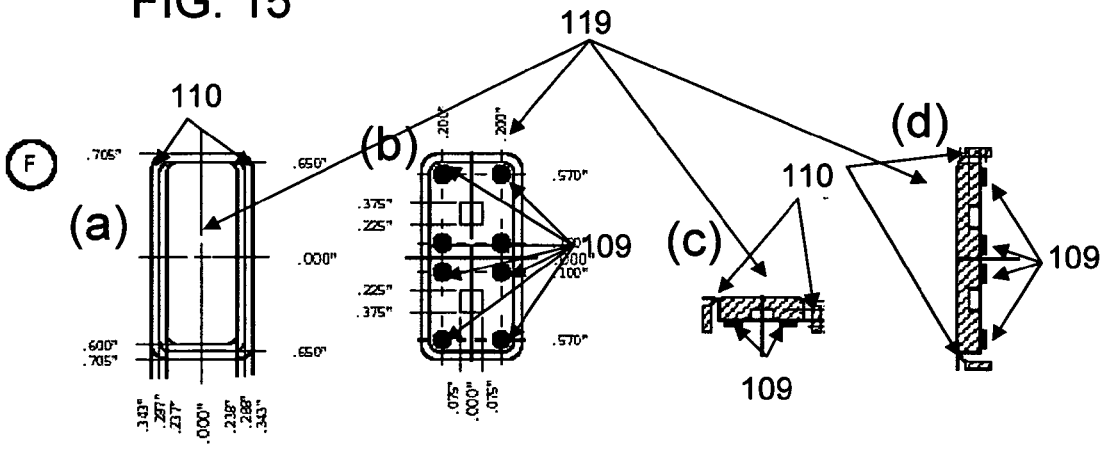
Figure 16:
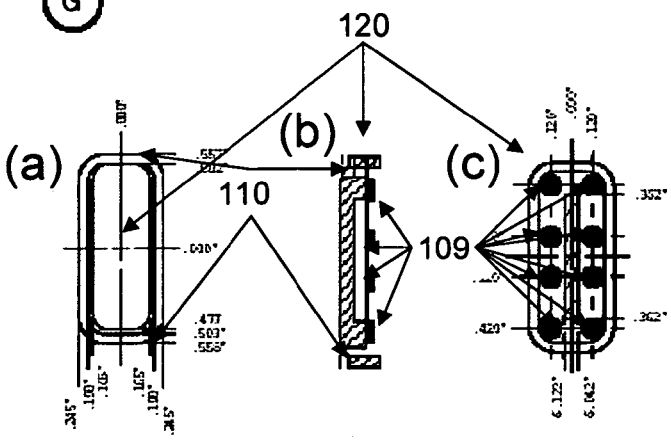
Figure 17:
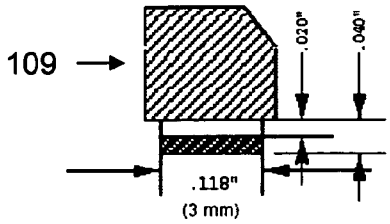
Figure 18:
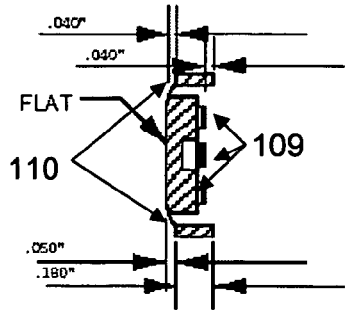
Figure 19:
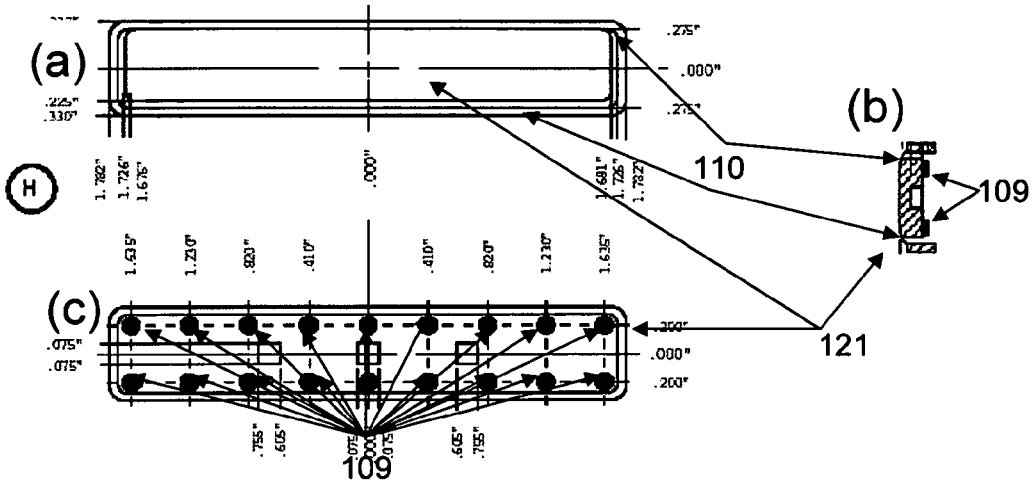
Figure 20:
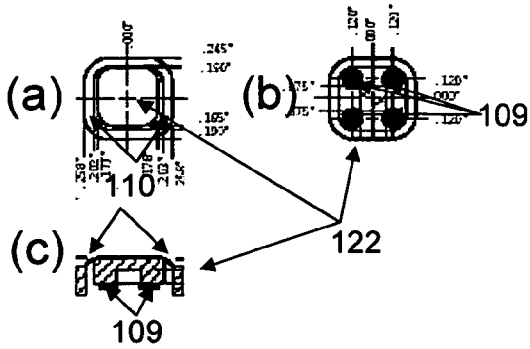
Figure 21:
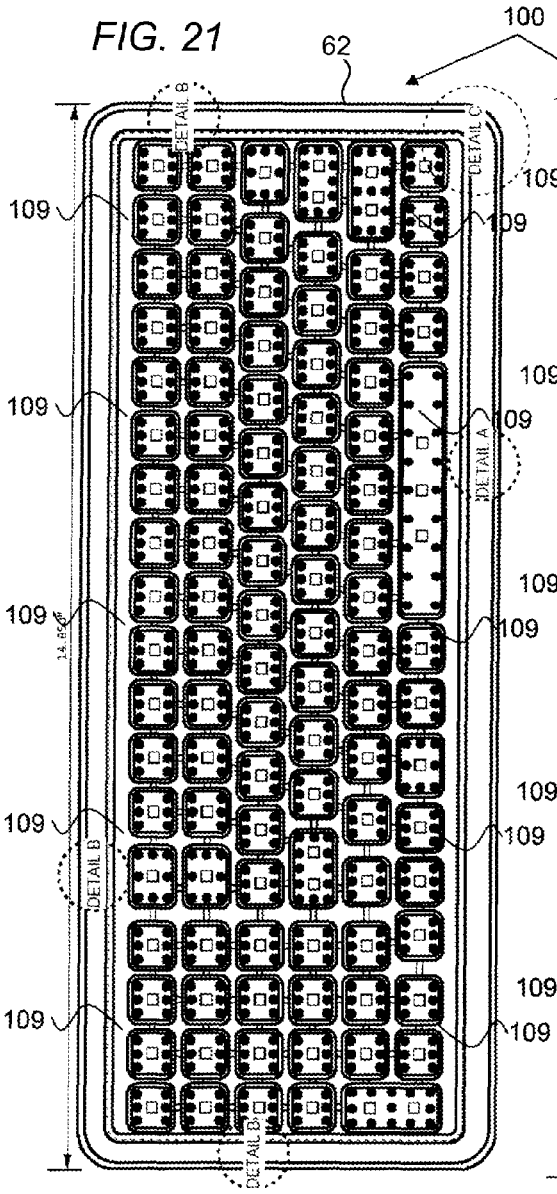
Figure 22:
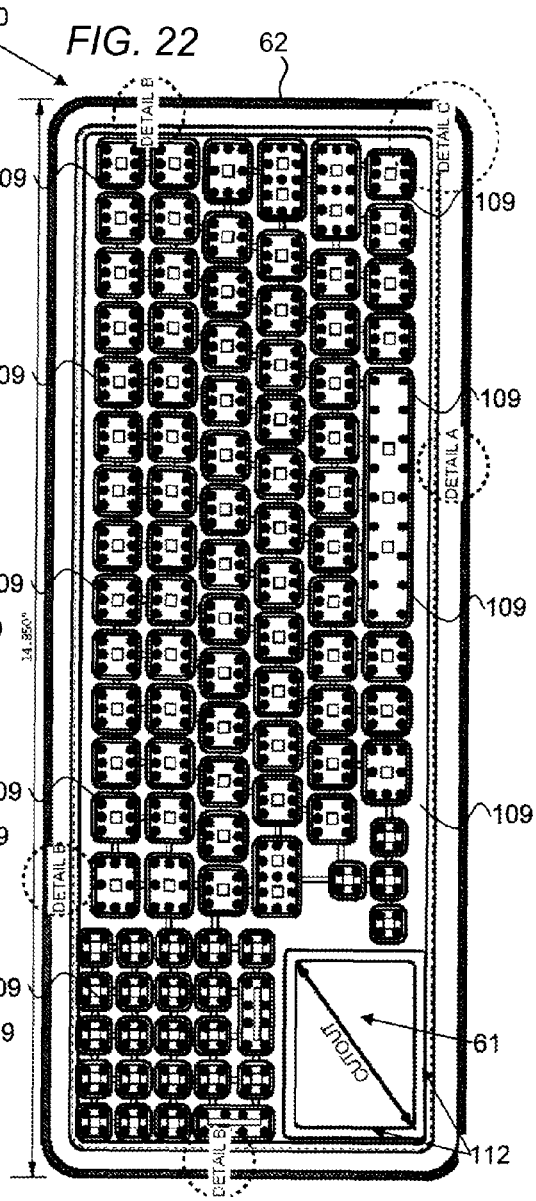
Figure 23:
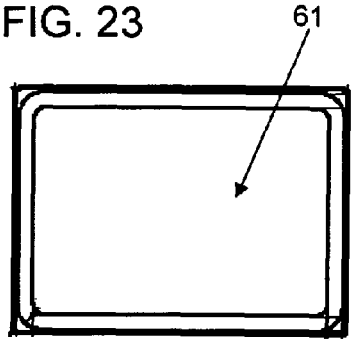
Figure 24:
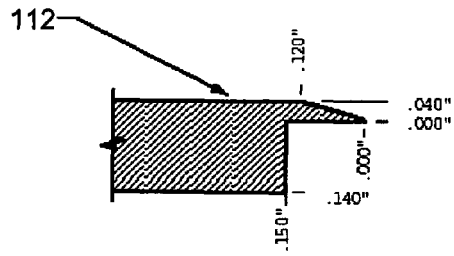
Figure 25:
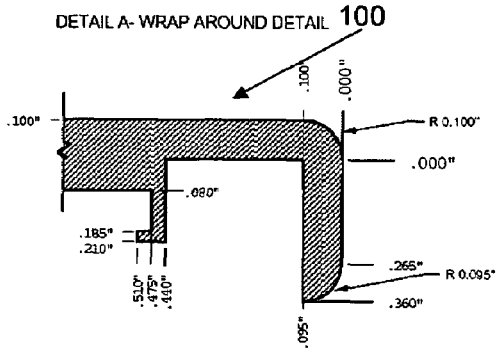
Figure 26:
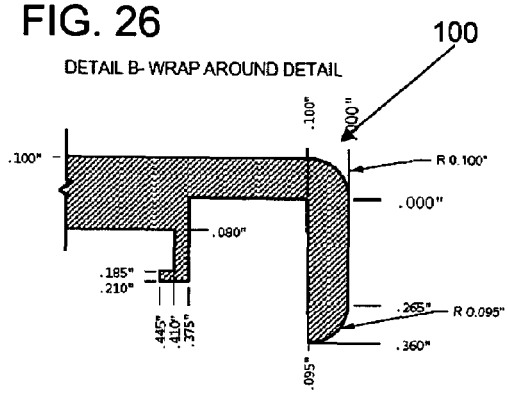
Figure 27:
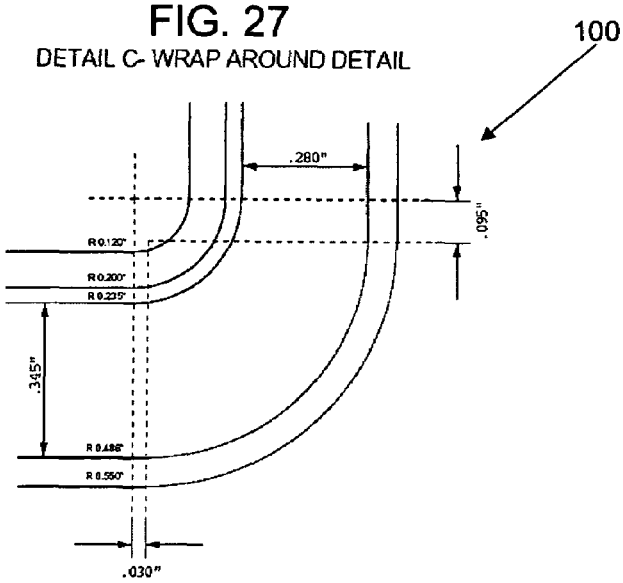
Figure 28:
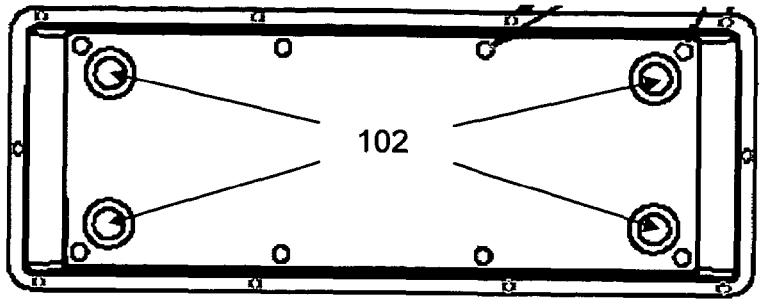
Figure 29:
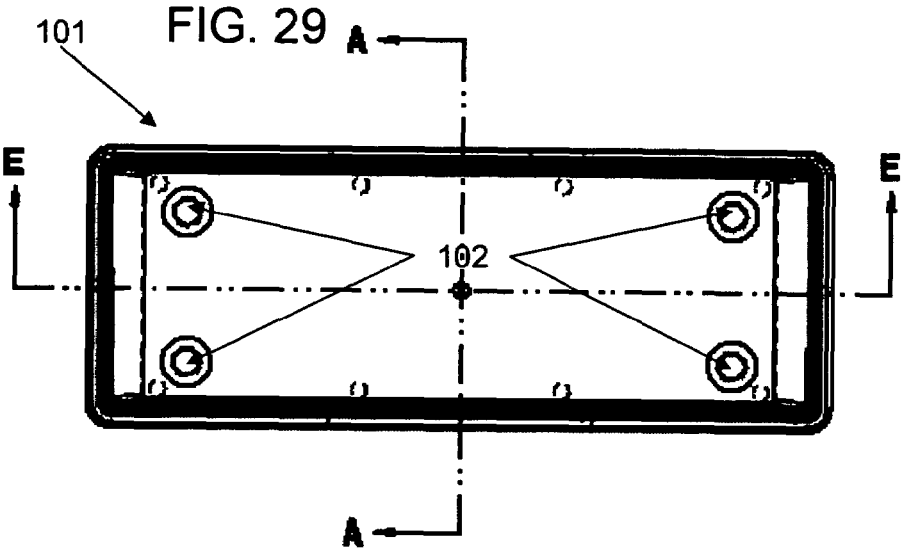
Figure 30:
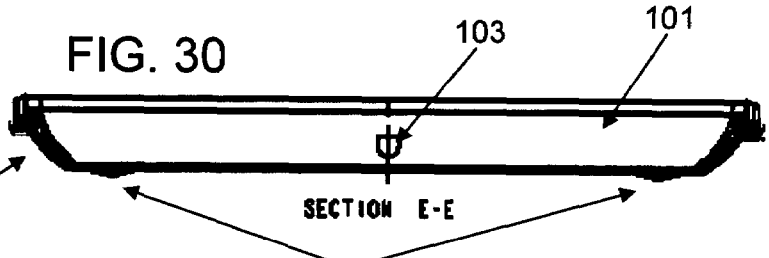
Figure 31:
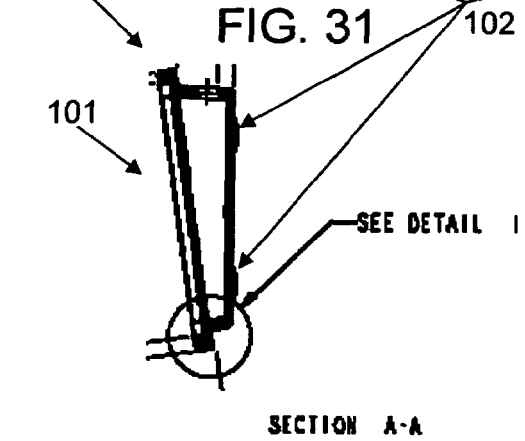
Figure 32:
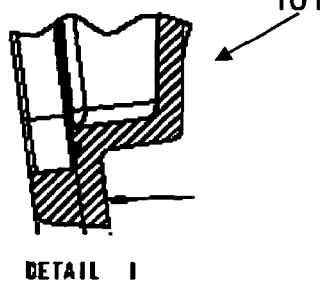
Figure 33:
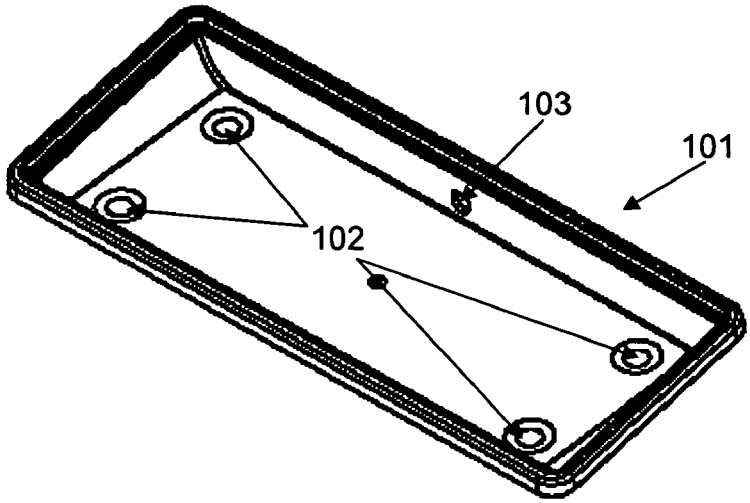
Figure 34:
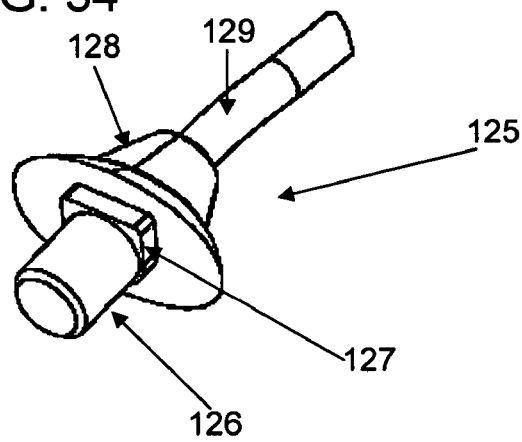
Figure 35:
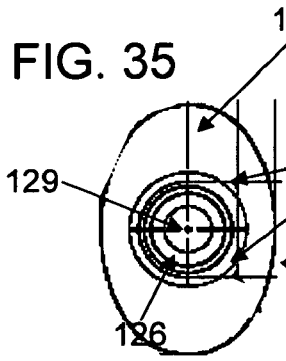
Figure 36:
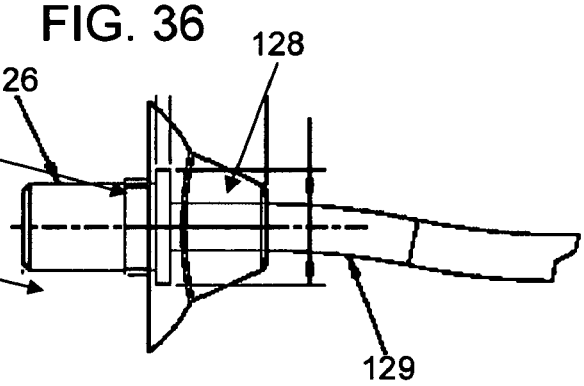

FIG. 10*a* shows a top plan view of the "A" key the present and an alternative embodiment;

FIG. 10*b* shows a bottom plan view of the "A" key the present and an alternative embodiment;

FIG. 10*c* shows a side plan view of the "A" key the present and an alternative embodiment;

FIG. 11*a* shows a top plan view of the "B" key an alternative embodiment;

FIG. 11*b* shows a bottom plan view of the "B" key an alternative embodiment;

FIG. 11*c* shows a side plan view of the "B" key an alternative embodiment;

FIG. 12*a* shows a top plan view of the "C" key of the present and an alternative embodiment;

FIG. 12*b* shows a bottom plan view of the "C" key the present embodiment;

FIG. 12*c* shows a side plan view of the "C" key of the present embodiment;

FIG. 13*a* shows a top plan view of the "D" key of the present and an alternative embodiment and the "J" key of an alternative embodiment;

FIG. 13*b* shows a bottom plan view of the "D" and "J" keys of the present and an alternative embodiment;

FIG. 13*c* shows a side plan view of the "D" and "J" keys of the present and an alternative embodiment;

FIG. 14*a* shows a top plan view of the "E" key of the present and an alternative embodiment;

FIG. 14*b* shows a bottom plan view of the "E" key of the present and an alternative embodiment;

FIG. 14*c* shows a side plan view of the "E" key of the present and an alternative embodiment;

FIG. 15*a* shows a top plan view of the "F" key the present and an alternative embodiment;

FIG. 15*b* shows a bottom plan view of the "F" key the present and an alternative embodiment;

FIG. 15*c* shows a side plan view of the "F" key the present and an alternative embodiment;

FIG. 15*d* shows an alternate side plan view of the "F" key the present and an alternative embodiment;

FIG. 16*a* shows a top plan view of the "G" key of an alternative embodiment;

FIG. 16*b* shows a side plan view of the "G" key of an alternative embodiment;

FIG. 16*c* shows a bottom plan view of the "G" key of an alternative embodiment;

FIG. 17 shows a side plan view of a pill of the present and and an alternative embodiment;

FIG. 18 shows a side plan view of the "A", "C", "D", and "E" size keys of the present and an alternative embodiment and the "J" key of an alternative embodiment;

FIG. 19*a* shows a top plan view of "H" key of the present and an alternative embodiment;

FIG. 19*b* shows a side plan view of "H" key of the present and an alternative embodiment;

FIG. 19*c* shows a bottom plan view of "H" key of the present and an alternative embodiment;

FIG. 20*a* shows a top plan view of the "I" key of an alternative embodiment;

FIG. 20*b* shows a bottom plan view of the "I" key of an alternative embodiment;

FIG. 20*c* shows a side plan view of the "I" key of an alternative embodiment;

FIG. 21 shows a bottom view of the keyboard top enclosure of the present embodiment;

FIG. 22 shows a top view of the keyboard top enclosure of an alternative embodiment;

FIG. 23 shows a bottom view of the pointing device of an alternative embodiment;

FIG. 24 shows a side view of the pointing device lip of an alternative embodiment viewed cross-sectionally;

FIG. 25 shows a side view of the keyboard top enclosure of the present and an alternative embodiment as viewed from cross-section Detail A;

FIG. 26 shows a side view of the keyboard top enclosure of the present and an alternative embodiment as viewed from cross-section Detail B;

FIG. 27 shows a top view of the keyboard top enclosure of the present and an alternative embodiment as viewed from Detail C;

FIG. 28 shows a bottom view of the keyboard bottom enclosure of the present embodiment;

FIG. 29 shows a top view of the keyboard bottom enclosure of the present embodiment;

FIG. 30 shows an end view of the keyboard bottom enclosure of the present embodiment as viewed from cross-section E-E;

FIG. 31 shows a side view of the keyboard bottom enclosure of the present embodiment as viewed from cross-section A-A;

FIG. 32 shows a side view of the keyboard bottom enclosure of the present embodiment as viewed from Detail 1;

FIG. 33 shows a top view of the keyboard bottom enclosure of the present embodiment;

FIG. 34 shows a top view of the keyboard cable assembly of the present embodiment;

FIG. 35 shows front view of the keyboard cable assembly of the present embodiment; and FIG. 36 shows a side view of the keyboard cable assembly of the present embodiment.

DETAILED DESCRIPTION OF ILLUSTRATIVE EMBODIMENTS

Although described with particular reference to a personal computer, the claimed subject matter can be implemented in any information technology system.

Those with skill in the computing arts will recognize that the disclosed embodiments have relevance to a wide variety of computing environments in addition to those specific examples described below.

All references, including publications, patent applications, and patents, cited herein are hereby incorporated by reference to the same extent as if each reference were individually and specifically indicated to be incorporated by reference and were set forth in its entirety herein.

Figure 1:
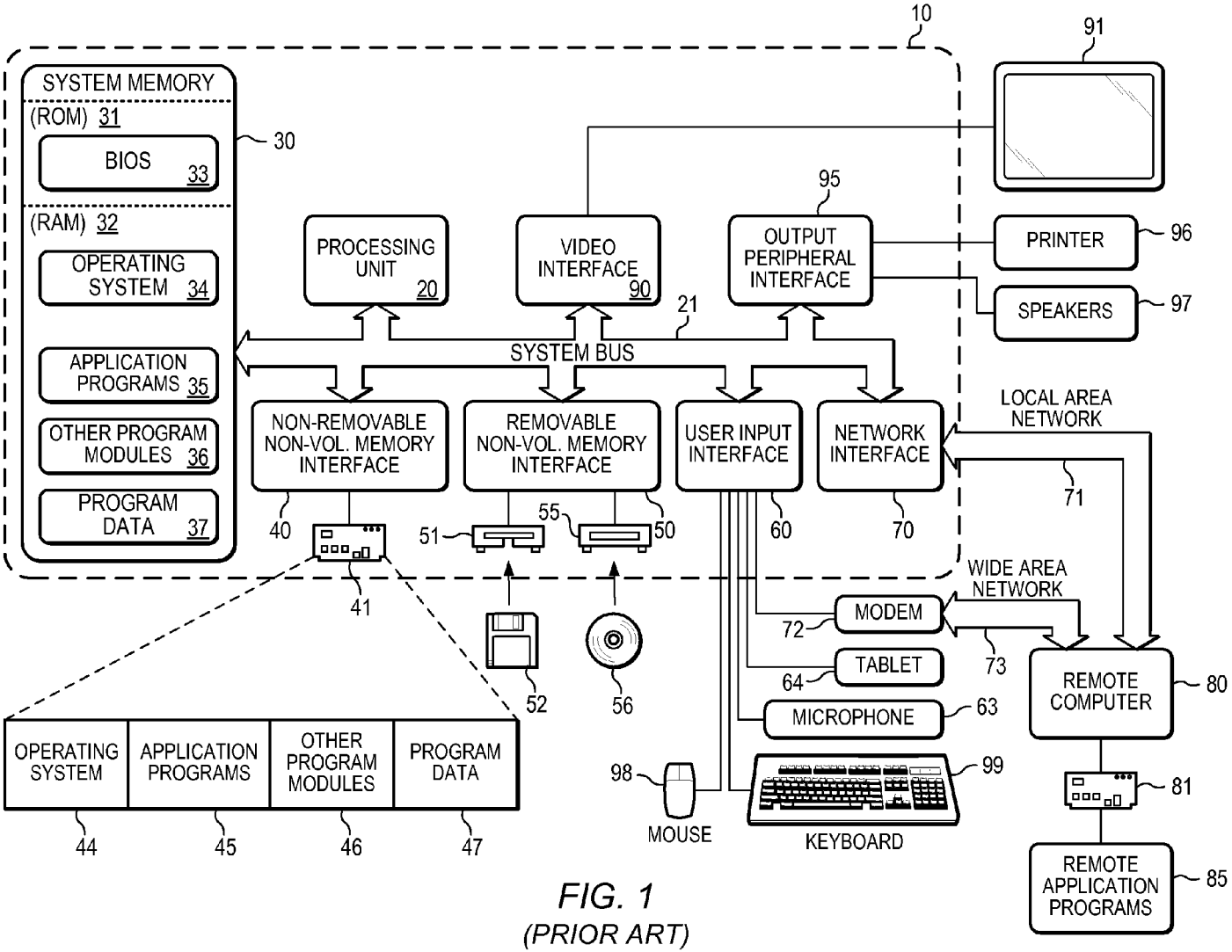
FIG. 1 (PRIOR ART)
FIG. 1 illustrates a computer system and related peripherals that may operate with the rugged keyboard of the present embodiment.

FIG. 1 illustrates an example of a suitable computing system 10 on which the invention may be implemented. The computing system 10 is only one example of a suitable computing environment and is not intended to suggest any limitation as to the scope of use or functionality of the invention. Neither should the computing system 10 be interpreted as having any dependency or requirement relating to any one or combination of components illustrated in the exemplary operating computing system 10.

With reference to FIG. 1, an exemplary system within a computing environment for implementing the invention includes a general purpose computing device in the form of a computing system 10. Components of the computing system 10 may include, but are not limited to, a processing unit 20, a system memory 30, and a system bus 21 that couples various system components including the system memory to the processing unit 20. The system bus 21 may be any of several types of bus structures including a memory bus or memory controller, a peripheral bus, and a local bus using any of a variety of bus architectures.

Computing system 10 typically includes a variety of computer readable media. Computer readable media can be any available media that can be accessed by the computing system 10 and includes both volatile and nonvolatile media, and removable and non-removable media. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer memory includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by the computing system 10.

The system memory 30 includes computer storage media in the form of volatile and/or nonvolatile memory such as read only memory (ROM) 31 and random access memory (RAM) 32. A basic input/output system 33 (BIOS), containing the basic routines that help to transfer information between elements within computing system 10, such as during start-up, is typically stored in ROM 31. RAM 32 typically contains data and/or program modules that are immediately accessible to and/or presently being operated on by processing unit 20. By way of example, and not limitation, FIG. 1 illustrates operating system 34, application programs 35, other program modules 36 and program data 37.

Computing system 10 may also include other removable/non-removable, volatile/nonvolatile computer storage media. By way of example only, FIG. 1 illustrates a hard disk drive 41 that reads from or writes to non-removable, nonvolatile magnetic media, a magnetic disk drive 51 that reads from or writes to a removable, nonvolatile magnetic disk 52, and an optical disk drive 55 that reads from or writes to a removable, nonvolatile optical disk 56 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 41 is typically connected to the system bus 21 through a non-removable memory interface such as interface 40, and magnetic disk drive 51 and optical disk drive 55 are typically connected to the system bus 21 by a removable memory interface, such as interface 50.

The drives and their associated computer storage media, discussed above and illustrated in FIG. 1, provide storage of computer readable instructions, data structures, program modules and other data for the computing system 10. In FIG. 1, for example, hard disk drive 41 is illustrated as storing operating system 44, application programs 45, other program modules 46 and program data 47. Note that these components can either be the same as or different from operating system 34, application programs 35, other program modules 36, and program data 37. Operating system 44, application programs 45, other program modules 46, and program data 47 are given different numbers hereto illustrate that, at a minimum, they are different copies.

A user may enter commands and information into the computing system 10 through input devices such as a tablet, or electronic digitizer, 64, a microphone 63, a keyboard 99, and pointing device 98, commonly referred to as a mouse, trackball, or touch pad. In particular, the present embodiment provides a novel rugged pointing device integrated into a keyboard, as described in detail below. Other input devices (not shown) may include a joystick, game pad, satellite dish, scanner, or the like. These and other input devices are often connected to the processing unit 20 through a user input interface 60 that is coupled to the system bus, but may be connected by other interface and bus structures, such as a parallel port, game port or a universal serial bus (USB).

A monitor 91 or other type of display device is also connected to the system bus 21 via an interface, such as a video interface 90. The monitor 91 may also be integrated with a touch-screen panel or the like. Note that the monitor and/or touch screen panel can be physically coupled to a housing in which the computing system 10 is incorporated, such as in a tablet-type personal computer. In addition, computers such as the computing system 10 may also include other peripheral output devices such as speakers 97 and printer 96, which may be connected through an output peripheral interface 94 or the like.

Computing system 10 may operate in a networked environment using logical connections to one or more remote computers, such as a remote computing system 80. The remote computing system 80 may be a personal computer, a server, a router, a network PC, a peer device or other common network node, and typically includes many or all of the elements described above relative to the computing system 10, although only a memory storage device 81 has been illustrated in FIG. 1. The logical connections depicted in FIG. 1 include a local area network (LAN) 71 and a wide area network (WAN) 73, but may also include other networks. Such networking environments are commonplace in offices, enterprise-wide computer networks, intranets and the Internet. For example, in the present embodiment, the computer system 10 may comprise the source machine from which data is being migrated, and the remote computing system 80 may comprise the destination machine. Note however that source and destination machines need not be connected by a network or any other means, but instead, data may be migrated via any media capable of being written by the source platform and read by the destination platform or platforms.

The computer system 10 of FIG. 1 may be in a harsh environment or may require use of interface devices, such as that of the present embodiment to operate in a harsh environment. As such, the following description explains the various features of the present embodiment of a rugged keyboard that achieves these purposes.

Figure 2:
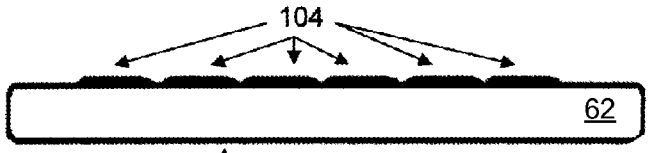
FIG. 2 shows a side view of the keyboard of the present embodiment.
Figure 3:
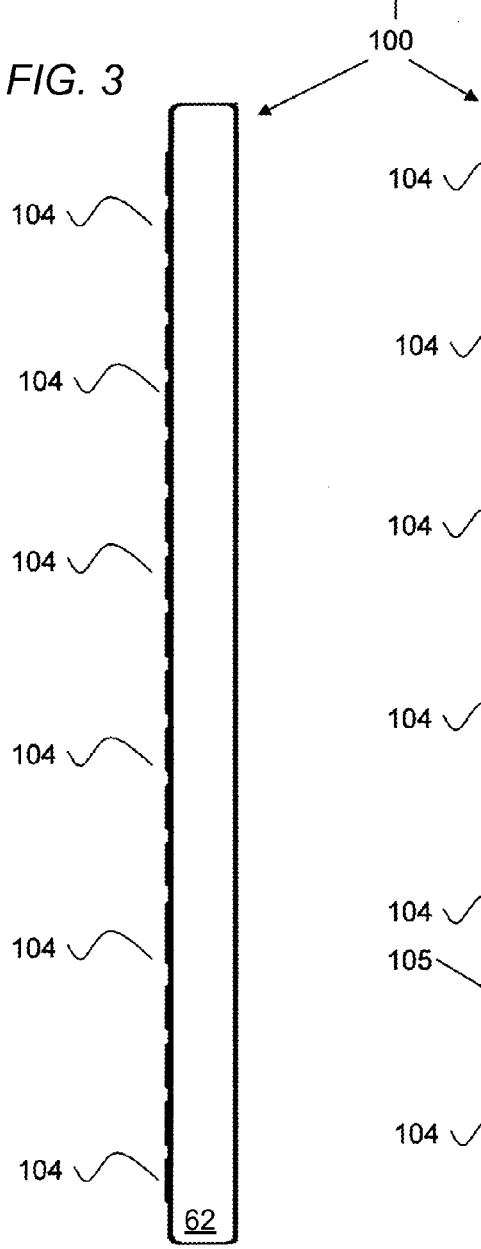
FIG. 3 shows an end view of the keyboard of the present embodiment.
Figure 4:
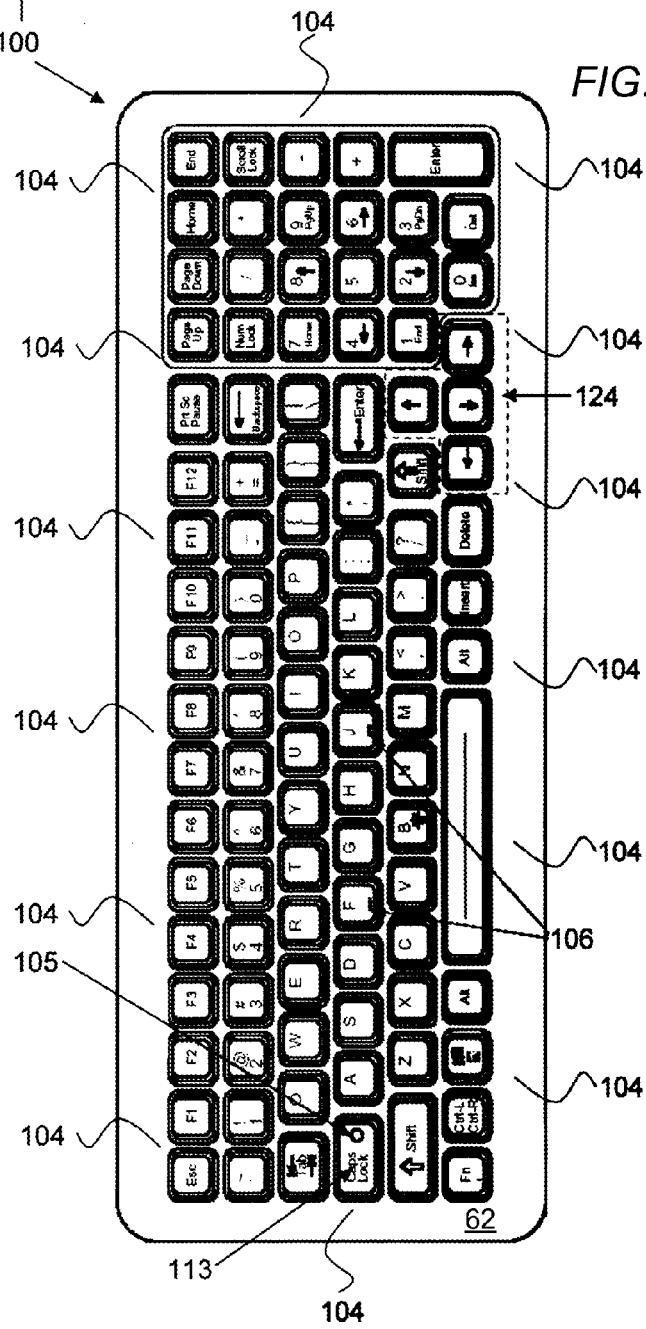
FIG. 4 shows a top view of the keyboard of the present embodiment.

FIGS. 2, 3, and 4, respectively, show a side view, end view, and top view of the rugged keyboard top enclosure 100 of the present embodiment. The top enclosure 100 has smooth surfaces, rounded corners, and rounded edges. There are no textures, seams, or crevices for contaminants to accumulate. The top enclosure 100 has a plurality of keys 104 that may have at least one pill 109 (See FIGS. 10-22) and correspond to pressure sensitive switches. When a key 104 is pressed, the associated pill 109 is compressed which signals a keyboard control. The keyboard control then determines which key 104 was pressed and transmits a signal to an associated computer.

Surrounding each key 104 is pliable webbing 110 (See FIGS. 10-22). The pliable webbing 110 creates a gene rally impenetrable seal between and around each key 104 and between the keys 104 and the top enclosure 100. The pliable webbing 110 also provides tactile resistance when a key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 provides a smooth sealed surface without unnecessary seams, crevices, or gaps. On the caps lock key 113 is an indicator light 105 that illuminates when the caps lock key 113 is enabled. Also, the top enclosure 100 has directional arrows 124. There may also be two key finder bars 106 to help users align their fingers to the keyboard 62 (See FIG. 4).

Figures 5, 6, 7:
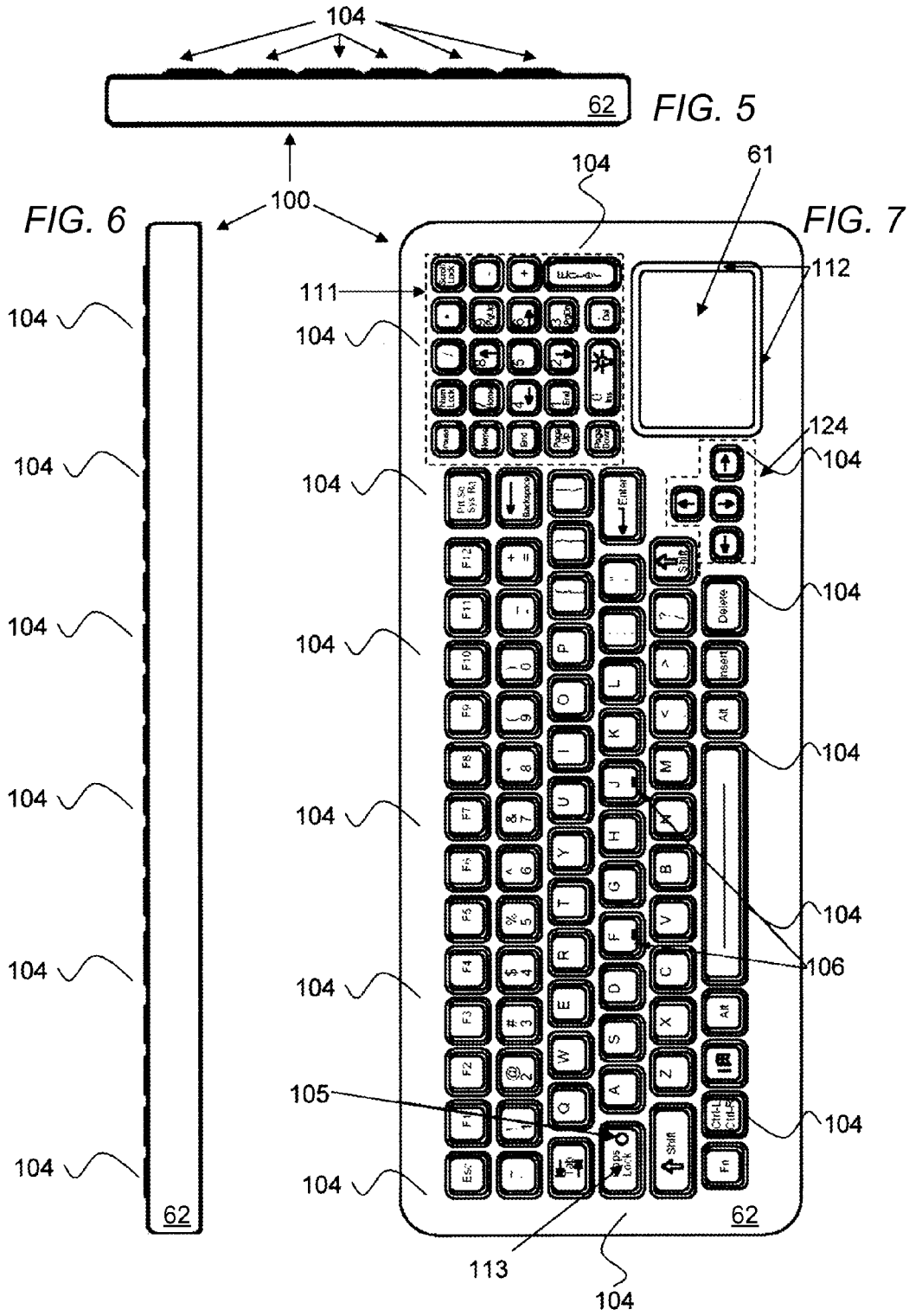
FIG. 5 shows a side view of the keyboard of an alternative embodiment.
FIG. 6 shows an end view of the keyboard of an alternative embodiment.
FIG. 7 shows a top view of the keyboard of an alternative embodiment.

FIGS. 5, 6, and 7, respectively, show a side view, end view, and top view of the rugged keyboard top enclosure 100 of an alternative embodiment. Referring to FIG. 7, the top enclosure 100 has smooth surfaces, rounded corners, and rounded edges. There are no textures, seams, or crevices for contaminants to accumulate. The top enclosure 100 has a plurality of keys 104 that may have at least one pill 109 (See FIGS. 10-22) and correspond to pressure sensitive switches. When a key 104 is pressed, the associated pill 109 is compressed which signals a keyboard control. The keyboard control circuit then determines which key 104 was pressed and transmits a signal to an associated computer.

Surrounding each key 104 is pliable webbing 110 (See FIGS. 10-22). The pliable webbing 110 creates a generally impenetrable seal between and around each key 104 and between the keys 104 and the top enclosure 100. The pliable webbing 110 also provides tactile resistance when a key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 provides a smooth sealed surface without unnecessary seams, crevices, or gaps. On the caps lock key 113 is an indicator light 105 that illuminates when the caps lock key 113 is enabled. Also, the top enclosure 100 has directional arrows 124. There may also be two key finder bars 106 to help users align their fingers to the keyboard 62 (See FIG. 4).

In addition, the number pad 111 and directional arrows 124 are reduced to allow for insertion of a pointing device 61 corresponding to a directionally sensitive device. Surrounding the pointing device 61 is a pointing device lip 112. The pointing device lip 112 provides a smooth surface transition from the top enclosure 100 to the pointing device 61 and creates an impenetrable seal between the top enclosure 100 and the pointing device 61.

Figure 8:
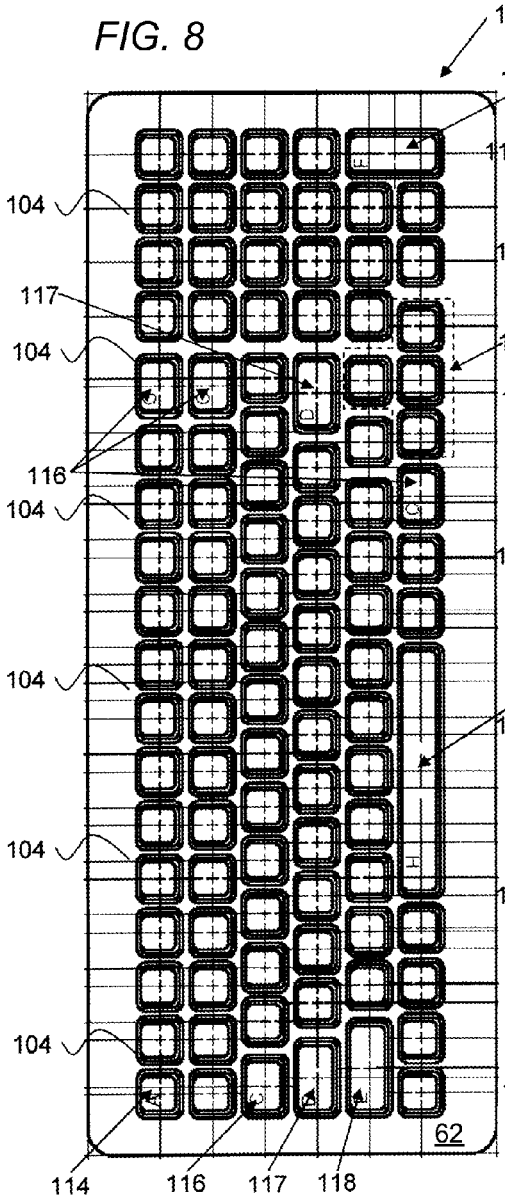
FIG. 8 shows a plan view of the keyboard of the present embodiment.
Figure 9:
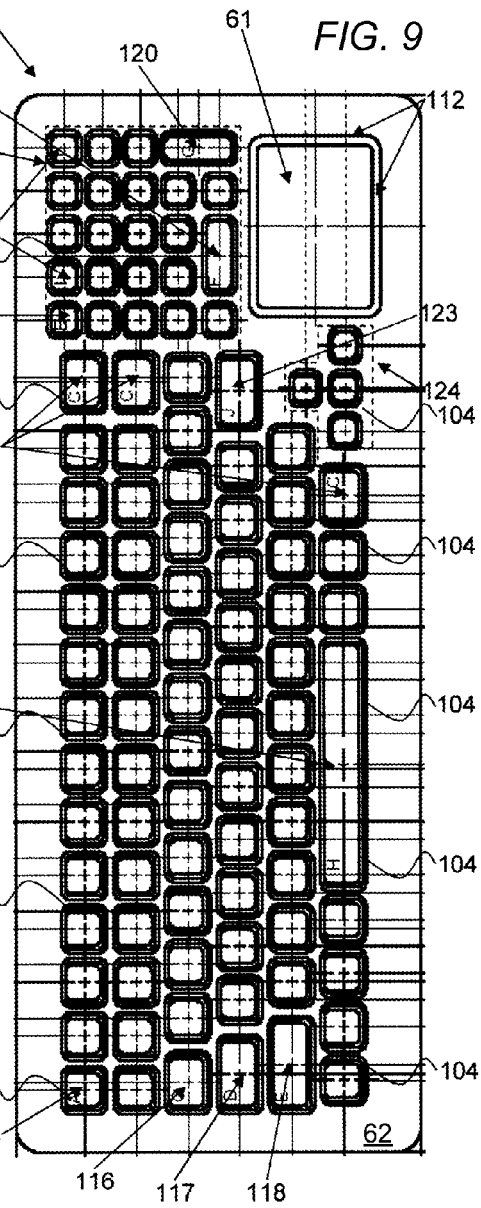
FIG. 9 shows a plan view of the keyboard of an alternative embodiment.

FIGS. 8 and 9, respectively, show a top plan view of the rugged keyboard top enclosure 100 of the present embodiment and a top plan view of the rugged keyboard top enclosure 100 of an alternative embodiment. The top enclosure 100 has several different key 104 sizes and shapes. The majority of the keys 104 are "A" size keys 114, but there are four "C" size keys 116, one "E" size key 118, one "F" size key 119, and one "H" size key 121. Referring to FIG. 8, there are also two "D" size keys 117. Referring to FIG. 9, all of the directional arrows 124 are "B" size keys 115. In addition, with the exception of two "I" size keys 122 and one "G" size key 120, the remainder of the number pad 112 is made of "B" size keys 115. The only additional keys are one "D" size key 117 and one "J" size key 123. The number pad 111 and directional arrows 124 are reduced to allow for insertion of a pointing device 61 corresponding to a directionally sensitive device. Surrounding the pointing device 61 is a pointing device lip 112. The pointing device lip 112 provides a smooth surface transition from the top enclosure 100 to the pointing device 61 and creates an impenetrable seal between the top enclosure 100 and the pointing device 61.

FIGS. 10*a*, 10*b*, and 10*c*, respectively, show a top plan view, bottom plan view, and side plan view of the "A" size keys 114 of the present and an alternative embodiment. Referring to FIGS. 10*a* and 10*c*, the pliable webbing 110 surrounds the "A" size keys 114. The pliable webbing 110 creates a generally impenetrable seal between and around each key 104 (See FIGS. 2-9) and between the keys 104 and the top enclosure 100 (See FIGS. 2-9). The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams, crevices, or gaps. Referring to FIGS. 10*b* and 10*c*, when a key 104 is pressed, the pill 109 beneath the key 104 is compressed which signals a keyboard control. The keyboard control then determines which key 104 was pressed and transmits a signal to an associated computer.

FIGS. 11*a*, 11*b*, and 11*c*, respectively, show a top plan view, bottom plan view, and side plan view of the "B" size keys 115 of an alternative embodiment. Referring to FIGS. 11*a* and 11*c*, the pliable webbing 110 surrounds the "B" size keys 114. The pliable webbing 110 creates a generally impenetrable seal between and around each key 104 (See FIGS. 2-9) and between the keys 104 and the top enclosure 100 (See FIGS. 2-9). The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams, crevices, or gaps. Referring to FIGS. 11*b* and 11*c*, when a key 104 is pressed, the pill 109 beneath the key 104 is pressed which signals a keyboard control. The keyboard control then determines which key 104 was pressed and transmits a signal to an associated computer.

FIGS. 12*a*, 12*b*, and 12*c*, respectively, show a top plan view, bottom plan view, and side plan view of the "C" size keys 116 of the present and an alternative embodiment. Referring to FIGS. 12*a* and 12*c*, the pliable webbing 110 surrounds the "C" size keys 116. The pliable webbing 110 creates a generally impenetrable seal between and around each key 104 and between the keys 104 and the top enclosure 100. The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams, crevices, or gaps. Referring to FIGS. 12*b* and 12*c*, when a key 104 is pressed, the pill 109 beneath the key 104 is compressed which signals a keyboard control. The keyboard control then determines which key 104 was pressed and transmits a signal to an associated computer.

FIGS. 13*a*, 13*b*, and 13*c*, respectively, show a top plan view, bottom plan view, and side plan view of the "D" size keys 117 of the present and an alternative embodiment and the "J" size keys 123 of an alternative embodiment. Referring to FIG. 13*a*, the "J" size keys 123 are identical to the "D" size keys 117 except that the caps lock key 113, has an indicator light 105 that illuminates when caps lock is enabled. Referring to FIGS. 13*a* and 13*c*, both the "D" size keys 117 and the "J" size keys 123 are surrounded by a pliable webbing 110. The pliable webbing 110 creates a generally impenetrable seal between and around each key 104 and between the keys 104 and the top enclosure 100. The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams, crevices, or gaps. Referring to FIGS. 13*b* and 13*c*, when a key 104 is pressed, the pill 109 beneath the key 104 is compressed which signals a keyboard control. The keyboard control then determines which key 104 was pressed and transmits a signal to an associated computer.

FIGS. 14*a*, 14*b*, and 14*c*, respectively, show a top plan view, bottom plan view, and side plan view of the "E" size keys 118 of the present and an alternative embodiment. Referring to FIGS. 14*a* and 14*c*, the pliable webbing 110 surrounds the "E" size keys 118. The pliable webbing 110 creates a generally impenetrable seal between and around each key 104 and between the keys 104 and the top enclosure 100 (See FIGS. 2-9). The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams. crevices, or gaps. Referring to FIGS. 14*b* and 14*c*, when a key 104 (See FIGS. 2-9) is pressed, the pill 109 beneath the key 104 is compressed which signals a keyboard control. The keyboard control then determines which key 104 was pressed and transmits a signal to an associated computer.

FIGS. 15*a*, 15*b*, 15*c*, and 15*d*, respectively, show a top plan view, bottom plan view. side plan view, and an alternate side plan view of the "F" size keys 119 of the present and an alternative embodiment. Referring to FIGS. 15*a*, 15*c*, and 15*d*, the pliable webbing 110 surrounds the "F" size keys 119. The pliable webbing 110 creates a generally impenetrable seal between and around each key 104 and between the keys 104 and the top enclosure 100. The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams, crevices, or gaps. Referring to FIGS. 15*b*, 15*c*, and 15*d*, when a key 104 is pressed, the pill 109 beneath the key 104 is compressed which signals a keyboard control. The keyboard control then determines which key 104 was pressed and transmits a signal to an associated computer.

FIGS. 16*a*, 16*b*, and 16*c*, respectively, show a top view, side view, and bottom view of the "G" size keys 120 of an alternative embodiment. Referring to FIGS. 16*a* and 16*b*, the pliable webbing 110 surrounds the "G" size keys 120. The pliable webbing 110 creates a generally impenetrable seal between and around each key 104 and between the keys 104 and the top enclosure 100. The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessay seams, crevices, or gaps. Referring to FIGS. 16*b* and 16*c*, when a key 104 is pressed, the pill 109 beneath the key 104 is compressed which signals a keyboard control. The keyboard control then determines which key 104 was pressed and transmits a signal to an associated computer.

FIG. 17 shows a side plan view of the pill 109 of the present and an alternative embodiment. The pill 109 resides beneath the key 104 When the key 104 is pressed, the pill 109 is compressed and a signal is transmitted to the keyboard control. The keyboard control then determines which key 104 was pressed and transmits a signal to an associated computer.

FIG. 18 shows a side plan view of the "A" size keys 114 (See FIGS. 8-10), the "C" size keys 116 (See FIGS. 8, 9 and 12), the "D" size keys 117 (See FIGS. 8, 9 and 13), and the "E" size keys 118 (See FIGS. 8, 9 and 14) of the present and an alternative embodiment and the "J" size keys 122 (See FIG. 20) of an alternative embodiment. The pliable webbing 110 surrounds the keys 104. The pliable webbing 110 creates a generally impenetrable seal between and around each key 104 and between the keys 104 and the top enclosure 100. The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams, crevices, or gaps. When a key 104 is pressed, the pill 109 beneath the key 104 is compressed which signals a keyboard control. The keyboard control then determines which key 104 was pressed and transmits a signal to an associated computer.

FIGS. 19*a*, 19*b*, and 19*c*, respectively, show a top plan view, side plan view, and bottom plan view of the "H" size keys 121 of the present and an alternative embodiment. Referring to FIGS. 19*a* and 19*b*, the pliable webbing 110 surrounds the "H" size keys 121. The pliable webbing 110 creates a generally impenetrable seal between and around each key 104 and between the keys 104 and the top enclosure 100 (See FIGS. 2-9). The pliable webbing 110 also provides tactile resistance when the key 104 (See FIGS. 2-9) is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams, crevices, or gaps. Referring to FIGS. 19*b* and 19*c*, when a key 104 is pressed, the pill 109 beneath the key 104 is compressed which signals a keyboard control. The keyboard control then determines which key 104 was pressed and transmits a signal to an associated computer.

FIGS. 20*a*, 20*b*, and 20*c*, respectively, show a top plan view, bottom plan view, and side plan view of the "I" size keys 118 of an alternative embodiment. Referring to FIGS. 20*a* and 20*c*, the pliable webbing 110 surrounds the "I" size keys 122. The pliable webbing 110 creates a generally impenetrable seal between and around each key 104 and between the keys 104 and the top enclosure 100. The pliable webbing 110 also provides tactile resistance when the key 104 is pressed and return force when the key 104 is released. The thickness and material of the pliable webbing 110 determine the actuation and return force. The pliable webbing 110 also allows for a significantly lower key height and key travel distance. In addition, the pliable webbing 110 also provides a smooth sealed surface without unnecessary seams, crevices, or gaps. Referring to FIGS. 20*b* and 20*c*, when a key 104 is pressed, the pill 109 beneath the key 104 is compressed which signals a keyboard control. The keyboard control then determines which key 104 was pressed and transmits a signal to an associated computer.

FIGS. 21 and 22. respectively, show a bottom view of the rugged keyboard top enclosure 100 of the present embodiment and a bottom view of the rugged keyboard top enclosure 100 of an alternative embodiment. The bottom of the top enclosure 100, has a plurality of pills 109. When a key 104 is pressed, the pill 109 beneath the key 104 is compressed which signals a keyboard control. The keyboard control then determines which key 104 was pressed and transmits a signal to an associated computer. Referring to FIG. 22, there is a pointing device 61 corresponding to a directionally sensitive device. Surrounding the pointing device 61 is a pointing device lip 112. The pointing device lip 112 provides a smooth surface transition from the top enclosure 100 to the pointing device 61 and creates an impenetrable seal between the top enclosure 100 and the pointing device 61.

FIG. 23 shows a top view of the pointing device 61 of an alternative embodiment. The pointing device 61 corresponds to a directionally sensitive device which senses when, and in what direction, the pointing device was pushed or moved. The directionally sensitive device is electrically connected to the mouse control circuit. When the mouse control circuit receives information from the directionally sensitive device, the mouse control circuit transmits a signal to an associated computer system.

FIG. 24, shows a side view of the pointing device lip 112 of an alternative embodiment as viewed cross-sectionally. The pointing device lip 112 surrounds the pointing device 61. The pointing device lip 112 provides a smooth surface transition from the top enclosure 100 to the pointing device 61 and creates an impenetrable seal between the top enclosure 100 and the pointing device 61. The pointing device lip 112 also helps to maintain the completely smooth surface and lack of gaps and crevices of the top enclosure 100 (See FIGS. 2-9).

FIGS. 25, 26, and 27, respectively, show a side view as viewed from cross section Detail A, a side view as viewed from cross section Detail B, and a top view as viewed from Detail C of the top enclosure 100 of the present embodiment. The top enclosure 100 has smooth surfaces, rounded corners, and rounded edges. There are no textures, seams, or crevices for contaminants to accumulate.

FIGS. 28 and 29, respectively, show a bottom and top view of the bottom enclosure 101 of the present embodiment. The bottom enclosure 101 has feet 102 that are formed integrally from the bottom enclosure 101. The feet 102 are a convexity protruding out of the bottom enclosure 101 intended to raise the keyboard 62 off an associated table. The feet 102 are designed to be smooth and have minimal crevices. In addition, there is a cable hole 103 (See FIGS. 30 and 33) in the rear of the bottom enclosure for a cable 129 (See FIGS. 34-36) to connect the keyboard 62 to an associated computer system. The cable 129 passes through the cable hole 103 and is secured to the bottom enclosure 101 by a cable strain relief 128 (See FIGS. 34-36).

FIGS. 30 and 31, respectively show an end view as viewed from cross section E-E and a side view as viewed from cross section A-A of the bottom enclosure 101 of the present embodiment. The bottom enclosure 101 has feet 102 that are formed integrally from the bottom enclosure 101. The feet 102 are a convexity protruding out of the bottom enclosure 101 intended to raise the keyboard 62 off an associated table. The feet 102 are designed to be smooth and have minimal crevices. Referring to FIG. 30, there is a cable hole 103 in the bottom enclosure for a cable 129 to connect the keyboard 62 to an associated computer system. The cable 129 passes through the cable hole 103 and is secured to the bottom enclosure 101 by a cable strain relief 128.

FIG. 32 shows a side view of the bottom enclosure 101 of the present embodiment as viewed from cross section Detail 1. The top enclosure 100 has smooth surfaces, rounded corners, and rounded edges. There are no textures, seams, or crevices for contaminants to accumulate.

FIG. 33 shows a top view of the bottom enclosure 101 of the present embodiment. The bottom enclosure 101 has feet 102 that are formed integrally from the bottom enclosure 101. The feet 102 are a convexity protruding out of the bottom enclosure 101 intended to raise the keyboard 62 off an associated table. The feet 102 are designed to be smooth and have minimal crevices. In addition, there is a cable hole 103 in the rear of the bottom enclosure 101 for a cable 129 to connect the keyboard 62 to an associated computer system. The cable 129 passes through the cable hole 103 and is secured to the bottom enclosure 101 by a cable strain relief 128.

FIGS. 34, 35, and 36, respectively show a top, front, and side view of the cable assembly 125 of the present embodiment. The cable assembly 125 has a collar 126 and a cable attachment 127 that associate with the bottom enclosure 101 (See FIGS. 28-33). The cable attachment 127 resists twisting of the cable assembly 125 by having a "D" shape that fits into the "D" shaped cable hole 103. The cable strain relief 128 then fits flush against the rear of the bottom enclosure 101 to form a generally impenetrable seal. A cable 129 goes through the cable strain relief 128, the cable attachment 127, and the collar 126 to associate with the circuitry within the keyboard 62. The cable assembly 125 associates with the cable 129 in a generally impenetrable manner. The cable assembly 125 is also smooth and designed to have minimal seams and crevices where contaminants could accumulate.

Although the present invention has been described in connection with the preferred embodiments, it is not intended to be limited to the specific form set forth herein, but on the contrary, it is intended to cover such alternatives, modifications, and equivalents, as can be reasonably included within the spirit and scope of the invention as defined by the claims. The foregoing description of the preferred embodiments, therefore, is provided to enable any person skilled in the art to make or use the claimed subject matter. Various modifications to these embodiments will be readily apparent to those skilled in the art, and the generic principles defined herein may be applied to other embodiments without the use of the innovative faculty. Thus, the claimed subject matter is not intended to be limited to the embodiments shown herein but is to be accorded the widest scope consistent with the principles and novel features disclosed herein.

What is claimed is:

1. A keyboard, comprising:

a top enclosure having a surface comprising a plurality of keys, wherein at least two keys of the plurality of keys each have a pliable webbing substantially surrounding the key and wherein the pliable webbing forms a seal between the at least two keys and the top enclosure;

a seal edge;

a bottom enclosure coupled to the top enclosure through the seal edge, wherein the seal edge comprises:

a first internal lip operable to receive a keyboard control circuit; and a second outer lip forming a trough;

wherein one of the top enclosure or bottom enclosure comprises a rib that is operable to be received in the trough when the top enclosure is sealed on the bottom enclosure.

2. The keyboard of claim 1, wherein the rib is formed on an outer wall of the top enclosure or bottom enclosure and substantially circumscribes a perimeter of the top enclosure or bottom enclosure.

3. The keyboard of claim 1, wherein the seal edge substantially circumscribes a perimeter of the top enclosure and the bottom enclosure when the top enclosure is sealed on the bottom enclosure.

4. The keyboard of claim 1, wherein the keyboard control circuit comprises a top surface, a bottom surface, and a side edge and wherein the first internal lip supports a bottom surface of the keyboard control circuit without a separate fastener.

5. The keyboard of claim 1, wherein the keyboard control circuit comprises a top surface, a bottom surface, and a side edge and wherein the first internal lip is operable to wrap around the side edge and at least a portion of the top surface and at least a portion of the bottom surface of the keyboard control circuit.

6. The keyboard of claim 5, wherein the rib is substantially perpendicular to the top and bottom surfaces of the keyboard control circuit when the keyboard control circuit is received in the first internal lip and the top enclosure is sealed on the bottom enclosure.

7. The keyboard of claim 1, wherein substantially all of the plurality of keys extend above the top enclosure less than 0.09 inches.

8. The keyboard of claim 1, wherein the at least two keys each comprise at least one pill, and wherein the pill is made of a generally electrically conductive material such that when the pill is compressed an electrical signal is sent to the keyboard control circuit.

9. The keyboard of claim 1, wherein the bottom enclosure further comprises at least one foot formed integrally from the bottom enclosure and wherein the foot is generally free of texture and crevices.

10. The keyboard of claim 1, wherein the bottom enclosure further comprises a cable hole for a cable assembly; wherein the cable assembly comprises:

a collar operable to be received in the cable hole;

a cable strain relief coupled to the collar; and a cable received in the cable strain relief to form a generally impenetrable seal.

11. The keyboard of claim 1, further comprising a control circuit operable to power and control backlighting of the keyboard.

12. The keyboard of claim 1, further comprising a pointing region within the top enclosure, and a mouse control circuit operable to determine which direction the pointing region was pressed and operable to transmit a corresponding signal to an associated computer system.

13. The keyboard of claim 12, wherein the pointing region further comprises at least one button and the mouse control circuit further comprises at least one pressure sensitive switch that corresponds to the at least one button.

14. A keyboard, comprising:

a top enclosure having a generally impenetrable surface, the surface comprising a plurality of keys, wherein substantially all of the plurality of keys have low-key heights;

a pliable webbing surrounding at least two keys of the plurality of keys, wherein the pliable webbing is operable to form a substantially smooth, continuous surface between a top of each of the at least two keys and the top enclosure, and wherein the pliable webbing is operable to provide a tactile resistance force to a key press and is operable to provide a return force when the key press is released;

a bottom enclosure formed as a single unit that forms a generally impenetrable surface surrounding a keyboard control circuit and coupled to the top enclosure;

a seal edge;

wherein the bottom enclosure is coupled to the top enclosure through the seal edge, wherein the seal edge comprises:

a first internal lip operable to receive the keyboard control circuit; and a second outer lip forming a trough;

wherein one of the top enclosure or bottom enclosure comprises a rib that is operable to be received in the trough when the top enclosure is sealed on the bottom enclosure.

15. The keyboard of claim 14, wherein substantially all of the plurality of keys extend above the top enclosure less than 0.09 inches.

16. The keyboard of claim 14, wherein the pliable webbing is made from a non-conductive material.

17. The keyboard of claim 16, wherein the non-conductive material is silicone rubber.

18. The keyboard of claim 14, wherein the keyboard control circuit comprises a top surface, a bottom surface, and a side edge and wherein the first internal lip supports a bottom surface of the keyboard control circuit without a separate fastener.

19. The keyboard of claim 14, wherein the at least two keys each comprise at least one pill, and wherein the pill is made of a generally electrically conductive material such that when the pill is compressed an electrical signal is sent to the keyboard control circuit.

20. The keyboard of claim 14, wherein the bottom enclosure further comprises at least one foot formed integrally from the bottom enclosure and wherein the foot is generally free of texture and crevices.

21. The keyboard of claim 14, wherein the bottom enclosure further comprises a cable hole for a cable assembly; wherein the cable assembly comprises:

a collar operable to be received in the cable hole;

a cable strain relief coupled to the collar; and a cable received in the cable strain relief to form a generally impenetrable seal.

22. The keyboard of claim 14, further comprising a control circuit operable to power and control backlighting of the keyboard.

23. The keyboard of claim 14, further comprising a pointing region within the top enclosure, and a mouse control circuit to determine which direction the pointing region was pressed and operable to transmit a corresponding signal to an associated computer system.

24. The keyboard of claim 23, further comprising a pointing device lip that substantially surrounds the pointing region and wherein the pointing device lip forms a substantially smooth, continuous surface between the top enclosure and the pointing region.

25. The keyboard of claim 23, the pointing region further comprising at least one button.

26. The keyboard of claim 25, the mouse control circuit further comprising at least one pressure sensitive switch that corresponds to the at least one button.

* * * * *